United States Patent [19]

Bickerstaff et al.

[11] Patent Number: 4,870,446

[45] Date of Patent: Sep. 26, 1989

[54] APPARATUS FOR DISPENSING RELEASE OIL IN AN IMAGE FUSER

[75] Inventors: Alan E. Bickerstaff, London; Barry J. Collier, Henlow; Joseph F. Hale, Welwyn; Peter M. Hitchmough, Wirral; Ian Pitts, Bassingbourn; Ghulam Rasul, Hemel Hempstead; Barry Saggers, Aylesbury; Kevin J. Smyth, Luton; Duncan Stevenson, Welwyn Garden City; Mark A. Stewart, Broom, all of England

[73] Assignee: Xerox Corporation, Stamford, Conn.

[21] Appl. No.: 209,735

[22] Filed: Jun. 22, 1988

[51] Int. Cl.[4] ..... G03G 15/20

[52] U.S. Cl. ..... 355/282

[58] Field of Search ..... 355/3 FU, 14 FU, 3 R, 355/14 R, 10; 219/216

[56] References Cited

U.S. PATENT DOCUMENTS

| | | | |
|---|---|---|---|
| 3,180,278 | 4/1965 | Klein | 103/235 |
| 4,050,801 | 9/1977 | McCarroll et al. | 355/3 R |
| 4,087,676 | 5/1978 | Fukase | 219/216 |
| 4,214,549 | 7/1980 | Moser | 118/60 |
| 4,231,653 | 11/1980 | Nagahara et al. | 355/3 |
| 4,496,234 | 1/1985 | Schram | 355/3 FU |
| 4,512,650 | 4/1985 | Kocher | 355/3 |
| 4,668,073 | 5/1987 | Hatabe et al. | 355/3 FU |
| 4,727,394 | 2/1988 | Bov, Jr. et al. | 355/3 FU |
| 4,751,548 | 6/1988 | Lawson | 355/3 FU |
| 4,766,462 | 8/1988 | Dyer et al. | 355/3 FU X |

FOREIGN PATENT DOCUMENTS 58-200264 11/1983 Japan .

*Primary Examiner*—A. C. Prescott

[57] ABSTRACT

A liquid dispensing apparatus especially suitable for use in dispensing release oil in the fusing apparatus of a xerographic copier comprises a storage reservoir (101), a dispensing container (41) and an overflow tank (52). The storage reservoir (101) is arranged to deliver liquid to the dispensing container (41) on the application of heat, generated for example by operation of a fusing apparatus, to the storage reservoir. The dispensing container (41) includes an outlet through which liquid overflows into the overflow tank (52) when the liquid in the dispensing container reaches a predetermined level (53). Cooling of the liquid in the storage reservoir causes liquid to be drawn from the overflow tank back into the storage reservoir.

13 Claims, 4 Drawing Sheets

APPARATUS FOR DISPENSING RELEASE OIL IN AN IMAGE FUSER

BACKGROUND OF THE INVENTION

This invention relates generally to a liquid dispensing apparatus which is particularly, although not exclusively, suitable for use in the fuser of an electrostatographic recording machine such as, for example, a xerographic copier.

In a xerographic copier a light image of an original document to be reproduced is recorded in the form of a latent electrostatic image on a photosensitive member. The latent image is rendered visible by the application of a resin-based powder known as toner. The visual toner image is transferred electrostatically from the photosensitive member on to sheets of paper or other substrates. The toner image is then fixed or "fused", for example by applying heat and pressure, which causes the toner material to become soft and tacky whereby it is able to flow into the fibers or pores of the substrate or otherwise upon the surface thereof. Thereafter, as the toner material cools, it solidifies and is bonded firmly to the substrate. In the electrostatographic art generally the use of thermal energy and pressure for fixing toner images on to a substrate is well known.

It has long been recognized that one of the fastest and most positive methods of applying both heat and pressure for fusing the toner image to the substrate is by direct contact of the resin-based toner image with a hot surface such as a heat roller which also applies pressure to the substrate. One approach is to pass the substrate with the toner image thereon between a pair of opposed rollers forming a nip, at least one of the rollers being internally heated. The actual temperature and pressure ranges will of course vary depending upon the softening range of the particular resin used in the toner. Typically, however, it will be necessary to heat the toner powder above 180° C. Temperatures of 200° C. or even higher are not uncommon in commercial fusers.

A problem with this kind of fuser is that, as the toner becomes tacky, it can stick to the surface of the fuser roller which is undesirable because some of the toner on the fuser roller can then be transferred to subsequent substrates being fused. This effect, known as "offset", clearly impairs copy quality. Furthermore, if the rollers are rotated when there is no substrate present in the nip therebetween, toner may also be transferred from the fuser roller to the backup roller so that when a substrate subsequently passes through the nip some of the toner may be transferred to the reverse side thereof. Also, stripping failures may occur because substrates may stick to the rollers instead of simply passing between them.

An arrangement for minimizing the problem of offset has been to provide a fuser roller with an outer surface or covering of, for example, polytetrafluoroethylene known by the trade name Teflon, to which a liquid release agent such as silicone oil is applied. The thickness of the Teflon is typically of the order of tens of microns and the thickness of the oil is less than 1 micron. Silicone based oils, for example polydimethylsiloxane, which possess a relatively low surface energy, have been found to be suitable for use in the heated fuser roller environment where Teflon constitutes the outer surface of the fuser roller. In practice, a thin layer of silicone oil is applied to the surface of the heated roller to form an interface between the roller surface and the toner images carried on the substrate. Thus, a low surface energy layer is presented to the toner as it passes through the fuser nip thereby preventing toner from offsetting to the fuser roller surface.

In attempts to improve the quality of the image fused by a heat roller fuser, such rollers have been provided with conformable surfaces comprising silicone rubber or Viton (Trademark of E I Du Pont for a series of fluoroelastomers based on the copolymer of vinyladinefluoride and hexafluoropropylene). As in the case of the Teflon coated fuser roller, release fluids such as silicone based oils are applied to the surface of the silicone rubber or Viton to both minimize offsetting and to facilitate stripping. When the fuser system is one which provides for applying silicone oil to silicone rubber or Viton, a low viscosity silicone oil (i.e. in the order of 100 to 1000 centistokes) has most commonly been employed, although liquids of relatively high viscosity, for example 12,000 to 60,000 centistokes and higher, have also been used.

Various forms of applicator have been employed to supply the liquid release agent to the surface of the fuser roller. Thus, for example, U.S. Pat. No. 4,231,653 discloses an applicator comprising an elongate trough for containing a supply of release oil. A wick which is partially immersed in the release oil supply draws the oil up from the trough for application to the fuser via a pair of cooperating rollers in pressure contact, namely a driven oil application roller and a freely rotatable oil supply roller. The wick is in engagement with the oil supply roller and thus applies the release oil directly to the surface thereof. The oil supply roller slips on the application roller and is not rotated when there is some oil present between the two rollers, but as the oil runs out the oil supply roller is driven by the oil application roller since the coefficient of friction therebetween is increased. In other words, the oil supply roller is rotated only when there is little or no oil on the surface of the oil application roller due to the application of oil to the fuser and thus the cooperating roller pair acts as a metering device for checking the amount of release oil conveyed to the fuser.

In order to supply the release oil to the trough in an applicator of the kind just described, various devices have been used or proposed. In one arrangement, a peristaltic pump was used, requiring a drive motor, or a separate drive derived from one of the motors already in the copying machine. Because of the tiny amounts of release oil that have to be supplied, of the order of a few milliliters per day, a reduction gearing arrangement was also needed. This added to the complexity and cost of the machine. A simple alternative arrangement for supplying fluid to a controlled level is the inverted bottle or "chicken feeder" device. However, due to space constraints, when such a device has to be mounted near the fuser, problems can arise. Heat from the fuser causes air within the bottle to expand and drive excessive amounts of oil into the trough resulting in spillage.

U.S. patent application Ser. No. 140,179 filed December 31, 1987 discloses a release agent management (RAM) system for applying silicone oil to a heated fuser roll. The RAM comprises an airtight container which uses heated air to pump silicone oil from the container into a trough. The energy for heating the air is either ambient heat or a heating element disposed in the container.

Thus neither of these systems is entirely satisfactory for a compact and low cost copier, and it is an object of the present invention to meet the need for a low cost but reliable system for delivering release oil to a fuser.

Japanese publication No. 58-200264 published on November 21, 1983 discloses an oil applying device which utilizes a heater to effect a pressure rise in a container for causing a valve to open and close for allowing oil to flow from the container.

U.S. Pat. No. 3,180,278 issued on Apr. 27, 1965 discloses a fluid pump which uses a heater for transferring fluids from one vessel to another.

U.S. Pat. No. 4,512,650 discloses a heat and pressure fuser utilizing a release agent management system including a fuser oil supply bottle.

U.S. Pat. No. 4,087,676 issued on May 2, 1978 discloses a heat and pressure fuser apparatus including a wick for applying release agent material to a fuser roll.

BRIEF DESCRIPTION OF THE INVENTION

According to the present invention, there is provided liquid dispensing apparatus comprising a storage reservoir, a dispensing container and an overflow tank, wherein the storage reservoir is arranged to deliver liquid to the dispensing container on the application of heat to the storage reservoir, the dispensing container including an outlet through which liquid overflows into the overflow tank when the liquid in the dispensing container reaches a predetermined level, and wherein cooling of the liquid in the storage reservoir causes liquid to be drawn from the overflow tank back into the storage reservoir.

When a liquid dispensing apparatus in accordance with the invention is used in a xerographic fuser system, by using a sealed storage reservoir, and by ensuring that there is always an air space above the liquid, it is possible to cause release oil to be delivered to the supply trough each time the fuser is heated. The storage reservoir is located in close proximity to the fuser, and the heat which it absorbs from the fuser is adequate to pump out enough release oil for at least a day's operation of the machine. Release oil in excess of requirements overflows into the overflow tank, and is drawn back into the storage reservoir on cooling of the apparatus when it is switched off or when it has not been used for some time. If it is required, during operation of the machine to supply more release oil than the amount initially delivered on switching on the machine, it is possible to include a simple electrical heater in the storage reservoir so that release oil can be supplied on demand.

DETAILED DESCRIPTION OF THE DRAWINGS

Embodiments of the invention will now be described, by way of example, with reference to the accompanying drawings in which.

DESCRIPTION OF THE PREFERRED EMBODIMENT OF THE INVENTION

Figure 1:
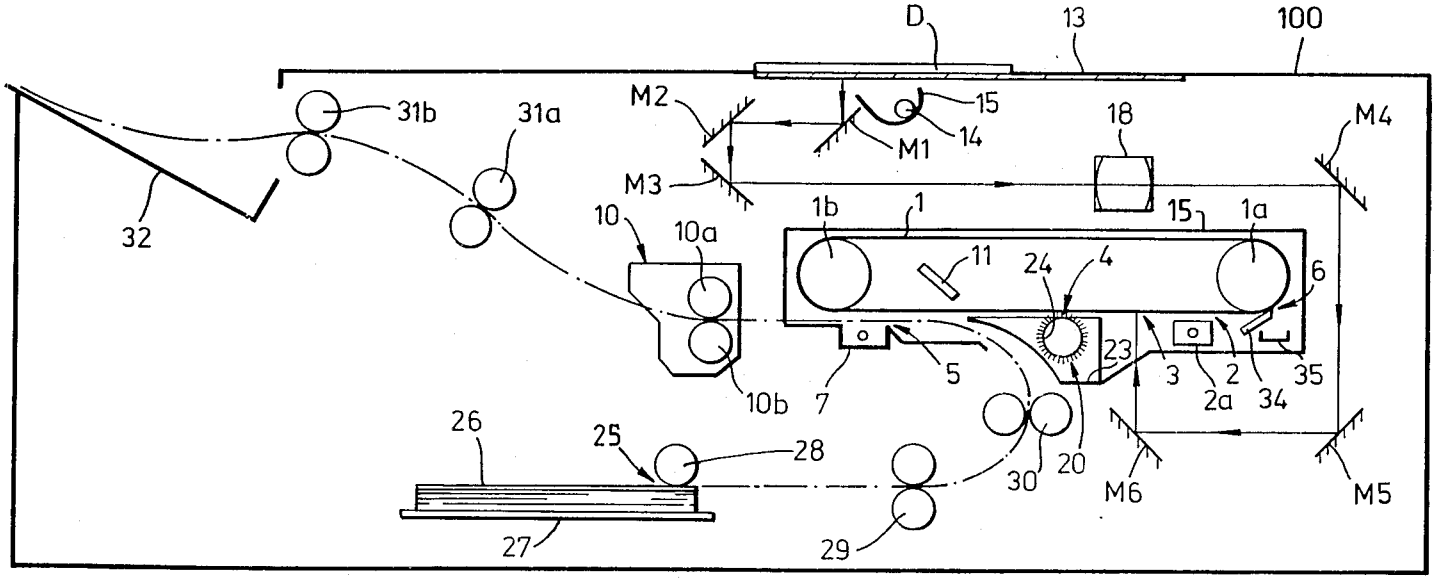
FIG. 1 is a schematic cross section of a xerographic copier incorporating a fusing apparatus which includes a liquid dispensing apparatus in accordance with the invention.

Referring first to FIG. 1, there is shown schematically a xerographic copying machine incorporating the present invention. The machine includes an endless flexible photoreceptor belt 1 mounted for rotation (in the clockwise direction as shown in FIG. 1) about support rollers **1*a* and 1*b* to carry the photosensitive imaging surface of the belt 1 sequentially through a series of xerographic processing stations, namely a charging station 2, an imaging station 3, a development station 4, a transfer station 5, and a cleaning station 6**.

The charging station 2 comprises a corotron 2a which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp is concentrated by an elliptical reflector 15 to cast a narrow strip of light on to the side of the original document D facing the platen 13. Document D thus exposed is imaged on to the photoreceptor 1 via a system of mirrors M1 to M6 and a focusing lens 18. The optical image selectively discharges the photoreceptor in image configuration, whereby an electrostatic latent image of the original document is laid down on the belt surface at imaging station 3. In order to copy the whole original document the lamp 14, the reflector 15, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path length constant. The photoreceptor 1 is also in motion whereby the image is laid down strip by strip to reproduce the whole of the original document as an image on the photoreceptor.

At the development station 4, a magnetic brush developer system 20 develops the electrostatic latent image into visible form. Here, toner is dispensed from a hopper (not shown) into developer housing 23 which contains a two-component developer mixture comprising a magnetically attractable carrier and the toner, which is deposited on the charged areas of belt 1 by a developer roller 24.

The developed image is transferred at transfer station 5 from the belt to a sheet of copy paper which is delivered into contact with the belt in synchronous relation to the image from a paper supply system 25 in which a stack of paper copy sheets 26 is stored on a tray 27. The top sheet of the stack in the tray is brought, as required, into feeding engagement with a top sheet separator/-feeder 28. Sheet feeder 28 feeds the top copy sheet of the stack towards the photoreceptor around a 180° path via two sets of nip roller pairs 29 and 30. The path followed by the copy sheets is denoted by a broken line in FIG. 1. At the transfer station 5 a transfer corotron 7 provides an electric field to assist in the transfer of the toner particles to a copy sheet.

The copy sheet bearing the developed image is then stripped from the belt 1 and subsequently conveyed to a fusing station 10 which comprises a heated roller fuser to which release oil is applied as described in more detail below. The image is fixed to the copy sheet by the heat and pressure in the nip between the two rollers 10a and 10b of the fuser. The final copy is fed by the fuser rollers into catch tray 32 via two further nip roller pairs 31a and 31b.

After transfer of the developed image from the belt some toner particles usually remain on the surface of the belt, and these are removed at the cleaning station 6 by a doctor blade 34 which scrapes residual toner from the belt. The toner particles thus removed fall into a receptacle 35 below. Also, any electrostatic charges remaining on the belt are discharged by exposure to an erase lamp 11 which provides an even distribution of light across the photoreceptor surface. The photoreceptor is then ready to be charged again by the charging corotron 2a as the first step in the next copy cycle.

The photoreceptor belt 1, the charge corotron 2a, the developer system 20, the transfer corotron 7, and the cleaning station 6 may all be incorporated in a process unit 12 adapted to be removably mounted in the main assembly 100 of the xerographic copier.

Figure 2:
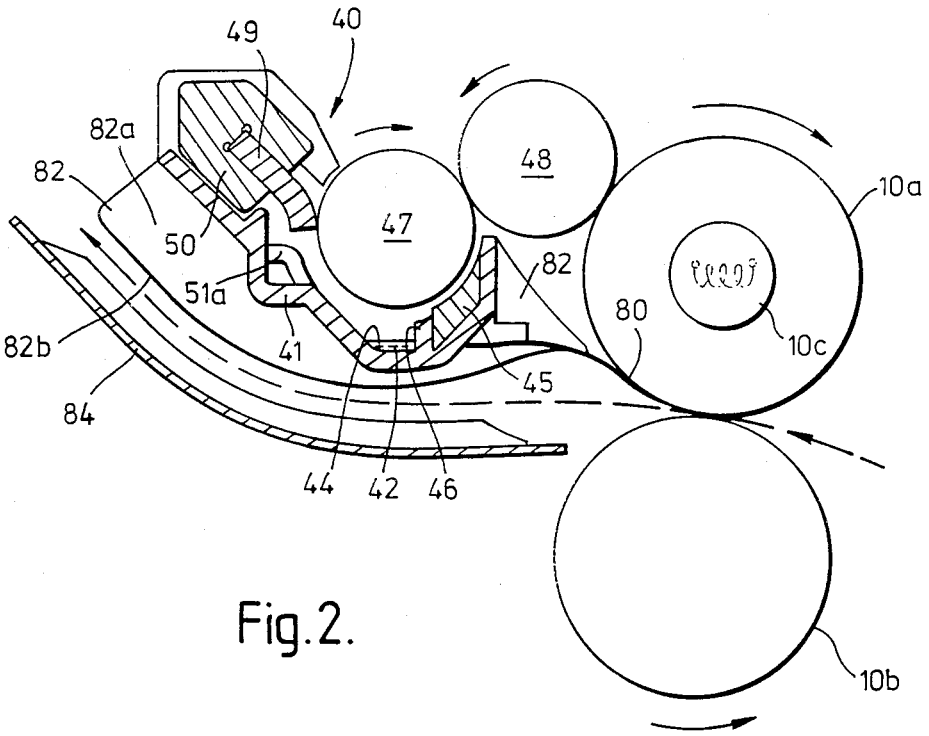
FIG. 2 is an enlarged cross section of the fusing apparatus incorporated in the copier of FIG. 1.

As shown in more detail in FIG. 2, the fuser 10 comprises a driven heat roller 10a made for example of a steel cylinder coated in Viton (Trademark) and having a 1KW tungsten filament lamp 10c disposed along its axis. A driven pressure roller 10bwhich may also comprise a steel cylinder with a Viton coating is urged against the heat roller 10a, for example by springs (not shown) suitably applying a force of approximately 68 kg, thereby forming a nip between the two rollers 10a and 10b where fusing takes place.

The path of a copy sheet through the fuser is represented by a broken-line arrow in FIG. 2. In order to prevent toner offset and to aid stripping the copy sheet from the heat roller 10a, a silicone lubricating oil is applied to the surface roller 10a by an applicator 40.

Figure 3:
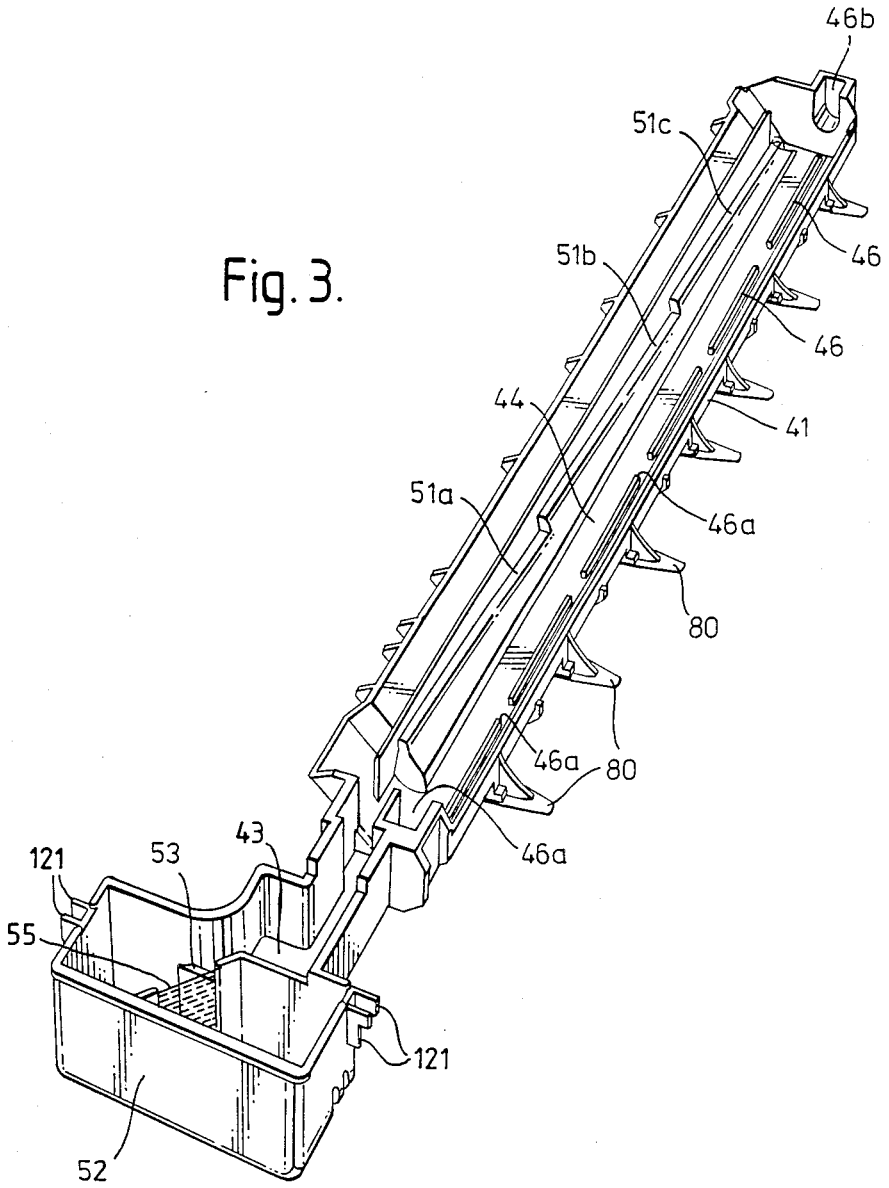
FIG. 3 is a perspective view from above showing the applicator trough of the fusing apparatus.

The oil applicator 40 comprises an elongate trough 41 which is also shown in FIG. 3. The release oil 42 is introduced into the trough 41 from a storage reservoir (FIGS. 4 and 5) at an inlet 43 at one end and flows along a channel 44 at the base of the trough towards the opposite end thereof. A wick 45 is retained internally adjacent the side of the trough by a castellated wall 46 extending upwardly from the base of the trough. It is noted that, for the sake of clarity, the wick is not shown in the perspective view of the trough in FIG. 3. Release oil is able to flow through the gaps 46a in the wall 46 to reach the wick 45 which draws the oil up and applies it to the surface of a metering roller 47 against which the wick 45 engages. The metering roller 47, in the form of a tube made for example of stainless steel is journaled in bearings 46a and 46b at the extremities of the trough 41. The manner in which the metering arrangement operates is described in detail below. The metering roller applies the release oil to a doner roller 48 with which it is in contact and the doner roller 48 transfers a controlled amount of oil to the surface of the heat roller 10a. The donor roller 48 may be in the form of a tube made of for example aluminum coated with silicone rubber. The direction of rotation of all the rollers is shown by short solid-line arrows in FIG. 2, but it is noted that only the heat roller 10a is directly driven. The pressure roller 10b, the donor roller 48 and metering roller 47 are all driven by the heat roller 10a.

A metering blade 49 which may be made for example of an elastomer such as Viton (trade mark) is fixed in a holder 50 with the holder end of the blade set at a predetermined distance from the surface of the metering roller 47 thus controlling the loading of the blade on the roller 47. In this manner the blade removes surplus oil from the roller 47 in a cutting tool fashion to leave thereon a coating of a predetermined thickness.

The metering blade 49 is arranged such that the surplus oil removed from the roller 47 will find its way under gravity back to channel 44 in the base of trough 41. A series of three similar ramps 51a, 51b, 51c are disposed in saw-tooth configuration along the full length of the side wall of the trough directly below the metering blade 49. Oil which is removed from roller 47 by the blade 49 falls onto the ramps 51a, 51b, 51c and fills the space between the ramps and the roller 47. The direction of rotation of roller 47 tends to prevent the oil falling directly back into the channel 44 at the bottom of the trough. Instead the oil flows down the ramps under gravity before spilling over the edge back into the channel 44 at the bottom of the trough. This arrangement ensures rapid and effective distribution of the release oil along the full length of the trough.

In order to set up a complete continuous circulation system the channel 44 at the base of the trough 41 may slope gently downwards from the end adjacent ramp 51c to the end of the trough adjacent input 43. Any excess oil may then be collected in an overflow tank 52 adjacent input 43 and the level of supply oil in the trough may be set at a desired limit by providing a weir 53 at the entrance to the reservoir at a predetermined height so that only when the oil level exceeds the desired level will it spill over the dam into the overflow tank 52.

Resilient blade-like stripper fingers 80 are provided at intervals along the length of the fuser system to ensure the stripping of the copy sheet paper from the heated fuser roller. To this end the remote end of the fingers 80 bears against the heat roller surface on the exit side of the fuser as shown in FIG. 2.

Figure 4:
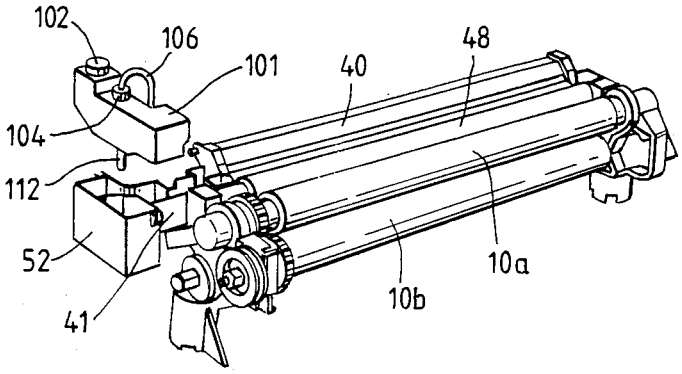
FIG. 4 is a perspective view of the fusing apparatus showing, in exploded configuration, the dispensing apparatus of the invention.
Figure 5:
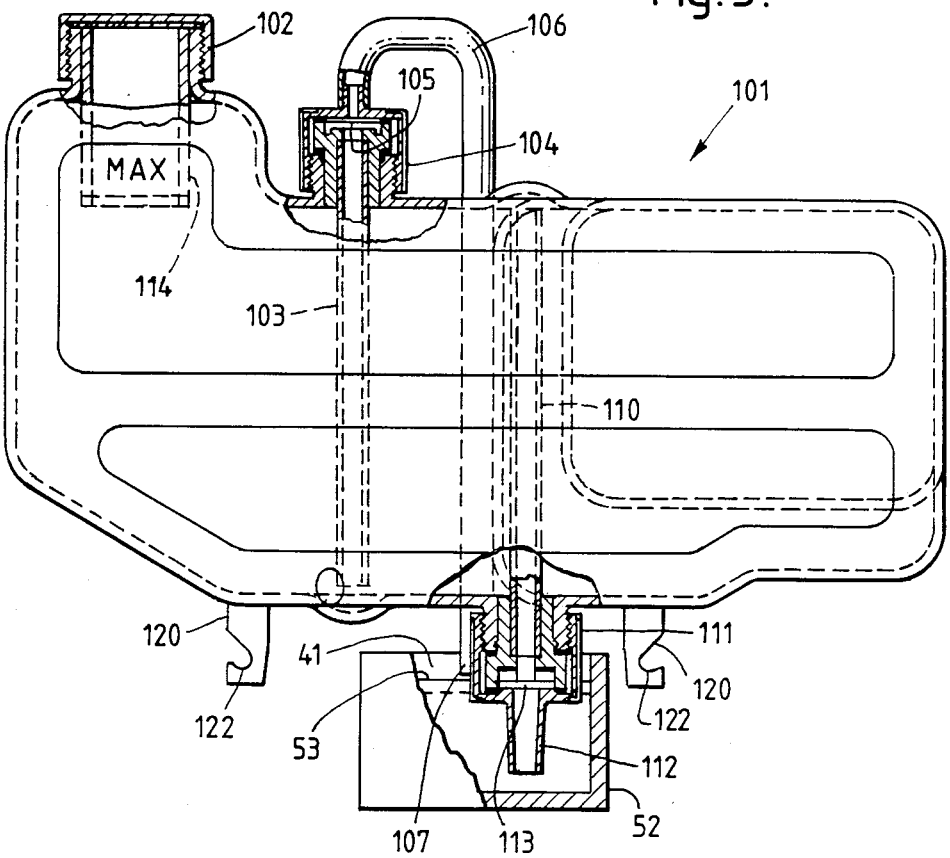
FIG. 5 is a cross sectional view of the dispensing apparatus.

Referring now to FIGS. 4 and 5, a liquid dispensing apparatus in accordance with the invention, and used to dispense release oil to the fusing apparatus described above, will be described.

A storage reservoir in the form of a bottle 101 for silicone release oil is adapted for mounting on the overflow tank 52 of trough 41. Trough 41, as described above, forms a dispensing container for the release oil. The bottle 101 is located on the overflow tank 52 by means of spigots 120 which extend downwards from the bottom of bottle 101, and which engage between pairs of lugs 121 adjacent the open top of overflow tank 52. Spigots 120 have hooked ends 122 through which pass two ends of a securing band such as an elastic band (not shown).

The bottle 101 is filled through an airtight oil cap 102. When the bottle warms up, due to heat generated by the fuser, the air trapped above the release oil in the bottle expands causing a rise in pressure. This pressure increase drives release oil up a pipe 103 within the bottle which has an open lower end adjacent the bottom of the interior of bottle 101, and an upper end which terminates within a valve 104 mounted on the top wall of the bottle. The valve 104 is a one way valve allowing the release oil to flow upwardly out of the bottle, but not allowing oil to return through pipe 103. A disc 105 within the body of valve 104 seats in sealing fashion over the upper end of pipe 103, but rises on to a serrated upper face of the valve body so that oil can flow past it into a pipe 106 mounted externally of the bottle 101. Pipe 106 extends initially upwardly from valve 105, then makes a U-turn to descend vertically so that its lower end 107 delivers release oil directly into inlet 43 of trough 41. As previously described, when the trough 41 is filled to a predetermined level with release oil, excess oil flows over the weir 53 into the overflow tank 52.

A second vertical pipe 110 within the bottle 101 has its open end near the top of the bottle, and extends vertically downwards into a valve 111 mounted in the bottom wall of the bottle. An outlet pipe 112 of the valve 111 extends vertically downwards, and has its open end near the bottom of overflow tank 52. A disc 113 within the valve 111 forms a seal against the valve body when it is pushed downwards by increased pressure within the bottle 101, thereby closing off the lower end of pipe 110.

When the copying machine is turned off, the fuser cools down, and so does the bottle 101. The air contained within the bottle cools and contracts, causing a reduction of air pressure in the bottle. When this occurs, the disc 105 of valve 104 drops to the lower smooth face of the valve body, and closes it off. On the other hand, disc 113 of valve 111 is drawn upwards, where it encounters a serrated upper face, which allows release oil contained in overflow tank 52 to be drawn up into pipe 110, and thence into bottle 101. In other words, excess oil expelled by the initial thermal expansion is eventually returned to the bottle due to thermal contraction. Smaller quantities of release oil may be delivered to the trough 41 during any temperature fluctuations which occur during machine operation.

Although other forms of valve may be used, the disc operated valves mentioned above work well with the small pressure differences which arise during the kind of use described above for the liquid dispensing apparatus of the invention. Thus, for example, spring loaded valves tend to be too heavy. Although it is desirable, it is not essential to have a perfect seal for operation of the device as described above. Discs made from materials with densities approximating that of the fluid work best. Gravity tends to return the discs to their closed positions when the system is thermally stable. The discs should be relatively rigid, so that they do not curl into a shape such that a seal cannot be made. If the disc is retained in some way, such as with a living hinge to form a flap valve, then the stiffness can be reduced such that surface tension is great enough to cause the relatively flexible discs to conform to the actual shape of the valve seat in the valve body.

On initial use of the apparatus, with the overflow tank 52 empty, a syphoning process is set up because air is able to enter the system through valve 111 and pipe 110. This facilitates rapid filling of the trough 41. Once the trough is full, release oil flows over the weir 53 into the overflow tank 52, and seals the tube 112. This prevents further air ingress, and the syphoning action stops as pressures reach a balance. Alternatively, syphoning can be prevented by allowing the ingress of air into the uppermost part of pipe 106. This approach is desirable when it is necessary to ensure that the bottle cannot accidentally lose its entire contents by syphonage, for example if the cap 102 is left off, or does not seal perfectly.

The pipe 110 preferably opens immediately adjacent the top of the bottle. This prevents the oil seeping out should the disc 113 of valve 111 fail to seal completely.

A filter 55 (FIG. 3) may be employed to prevent dirt and contaminants from entering the valves, and may be positioned such that oil flowing over weir 53 passes through it before collecting in the overflow tank 52. Suitable materials for this filter are woven metal mesh, etched metal mesh, sintered metal and plastic, or paper. When the invention is used in a photocopier, the contaminants to be arrested are paper fibers and developer carrier beads. The kinds of size or whitener used in paper manufacture do not affect the valves, so should be allowed to flow through the filter because they occur in sufficient quantities that they would soon clog a filter which arrested them.

In order for the apparatus of the invention to function correctly, it is important that a volume of air be trapped in the bottle to enable pumping to occur. Although it is possible to allow the operator to fill the bottle only to an indicated "maximum" level, it is preferable to use a device to prevent overfilling. Such a device may consist of a tube 114 in the neck of the bottle, which is arranged such that if the bottle is filled beyond the desired maximum, the oil will fill the tube but will leave air in the bottle outside the tube but above the "maximum" mark.

In cases where it is desired to supply controlled amounts of liquid, a heater, such as a simple electrical resistive heater, may be mounted within or adjacent the bottle so that liquid can be supplied on demand by simply switching on the heater.

What is claimed is:

1. Liquid dispensing apparatus comprising a storage reservoir, a dispensing container and an overflow tank, wherein the storage reservoir is arranged to deliver liquid to the dispensing container on the application of heat to the storage reservoir, the dispensing container including an outlet through which liquid overflows into the overflow tank when the liquid in the dispensing container reaches a predetermined level, and wherein cooling of the liquid in the storage reservoir causes liquid to be drawn from the overflow tank back into the storage reservoir.

2. The apparatus of claim 1 wherein the storage reservoir is mounted adjacent an apparatus which in use consumes the liquid in said dispensing container, and which generates sufficient heat to cause said delivery of liquid to the dispensing container.

3. The apparatus of claim 2 wherein the storage reservoir is a substantially sealed chamber whereby the thermal expansion of gas or vapor therein causes expulsion of the liquid and gives rise to said delivery of the liquid to the dispensing container.

4. The apparatus of claim 3, including a first one way valve for the liquid permitting liquid flow from the storage reservoir to the dispensing container.

5. The apparatus of claim 4 including a delivery pipe having an open end adjacent the bottom of the storage reservoir and extending upwardly through and out of the storage reservoir, for delivering liquid to the dispensing container.

6. The apparatus of claim 5, including a second one way valve for the liquid, permitting liquid flow from the overflow tank to the storage reservoir.

7. The apparatus of claims 6, including a return pipe extending from the overflow tank to the top of the storage reservoir.

8. The apparatus of claim 1 wherein the storage reservoir is a substantially sealed chamber whereby the thermal expansion of gas or vapor therein causes expulsion of the liquid and gives rise to said delivery of the liquid to the dispensing container.

9. The apparatus of claim 8, including a first one way valve for the liquid permitting liquid flow from the storage reservoir to the dispensing container.

10. The apparatus of claim 9 including a delivery pipe having an open end adjacent the bottom of the storage reservoir and extending upwardly through and out of the storage reservoir, for delivering liquid to the dispensing container.

11. The apparatus of claim 10, including a second one way valve for the liquid, permitting liquid flow from the overflow tank to the storage reservoir.

12. The apparatus of claim 11, including a return pipe extending from the overflow tank to the top of the storage reservoir.

13. The apparatus of 12, including a heater for heating on demand the contents of the storage reservoir.

* * * * *